US005961785A

United States Patent [19]

Kahl et al.

[11] Patent Number: 5,961,785

[45] Date of Patent: Oct. 5, 1999

[54] MACHINE FOR MANUFACTURING A CONTINUOUS MATERIAL WEB

[75] Inventors: Peter Kahl, Gerstetten; Robert Wolf, Herbrechtingen; Georg Kugler, Heidenheim; Markus Oechsle, Bartolomae, all of Germany

[73] Assignee: Voith Sulzer Papiermaschinen GmbH, Heidenheim, Germany

[21] Appl. No.: 08/996,910

[22] Filed: Dec. 23, 1997

[30] Foreign Application Priority Data

Dec. 24, 1996 [DE] Germany ..... 196 54 420

[51] Int. Cl.[6] ..... D21F 1/48; D21F 3/10

[52] U.S. Cl. ..... 162/363; 162/366; 162/370

[58] Field of Search ..... 162/370, 369, 162/366, 368, 372; 34/108, 116, 122, 130, 114; 492/20, 30

[56] References Cited

U.S. PATENT DOCUMENTS

| | | | |
|---|---|---|---|
| 242,815 | 6/1881 | Cronk | 162/366 |
| 811,660 | 1/1906 | Parker | 162/370 |
| 1,732,925 | 10/1929 | Carroll | 162/366 |
| 2,905,969 | 9/1959 | Gilbert . | |
| 3,037,557 | 6/1962 | Faeber et al. | 162/370 |
| 4,383,877 | 5/1983 | LaValley | 156/155 |
| 5,135,614 | 8/1992 | Aula et al. | 162/217 |

FOREIGN PATENT DOCUMENTS

| | | |
|---|---|---|
| 9106451 | 8/1991 | Germany . |
| 4314475 | 12/1993 | Germany . |
| 4322244 | 2/1994 | Germany . |
| 9415051 | 1/1995 | Germany . |

OTHER PUBLICATIONS

German Search Report dated Jul. 30, 1997 issued in connection with German Patent Application No. 196 54 420.3.

*Primary Examiner*—Peter Chin
*Assistant Examiner*—Kevin Cronin
*Attorney, Agent, or Firm*—Greenblum & Bernstein P.L.C.

[57] ABSTRACT

A machine for manufacturing a continuous material web, in particular a paper or cardboard web, with at least one perforated cylinder sleeve and a suction roll exhibiting a manhole around which the material web is guided preferably with the aid of a transport band, whereby the interior of the suction roll can be put under a vacuum and is subdivided into at least two sections by a partition wall that is arranged essentially perpendicular to the rotation axis of the suction roll, wherein the partition wall is subdivided into sections and/or is manufactured of a flexible material and can thereby be inserted through the manhole and into the roll interior.

19 Claims, 2 Drawing Sheets

MACHINE FOR MANUFACTURING A CONTINUOUS MATERIAL WEB

CROSS-REFERENCE TO RELATED APPLICATION

The present invention claims the priority under 35 U.S.C. § 119 of German Application No. 196 54 420.3 filed Dec. 24, 1996, the disclosure of which is expressly incorporated by reference herein in its entirety.

BACKGROUND INFORMATION

1. Field of the Invention

The invention relates to a drying section for a machine for processing a continuous material web, in particular a web of paper or cardboard.

2. Discussion of Background Information

Drying sections for processing a web are known. It is also known that suction rolls to be put under a vacuum may have perforated cylinder sleeves, and that different pressure conditions may be created in different sections of the suction roll with the aid of a separating wall positioned in the interior of the roll. Heretofore, the insertion of such partition walls had to occur during the manufacturing of the suction roll, and retrofitting the roll at a later point in time was practically impossible.

SUMMARY OF THE INVENTION

The invention overcomes these disadvantages by providing a drying section including a manhole in a suction roll that provides access to the roll interior, and a partition wall that divides the roll interior into sections formed essentially perpendicular to the axis of rotation. The invention is distinguished in that the partition wall of the suction roll is subdivided into sections and can thereby be installed in the suction roll interior through a manhole, i.e. through a service opening in the area of the end wall of the suction roll. The partition wall may be constructed of a flexible material, such that it can be inserted through the manhole and installed in one piece in the interior of the suction roll. The finished partition wall can then be mounted in the interior of the suction roll.

The present invention provides a machine for manufacturing a continuous material web, in particular a paper or cardboard web, which includes: at least one perforated cylinder sleeve; a suction roll including an interior surface that defines a roll interior, wherein the roll interior can be put under a vacuum, and wherein the material web is guided on the suction roll, preferably with the aid of a transport band; a partition wall that divides the roll interior into at least two sections that are arranged essentially perpendicular to a rotation axis of the suction roll; and a manhole in the suction roll, where the partition wall can be inserted through the manhole into the roll interior. Moreover, the material web may be guided on the suction roll with the aid of a transport band. Further, the partition wall is subdivided into sections. The partition wall may include a flexible material. Additionally, according to the present invention the partition wall may include a brace. Moreover, the partition wall may include a spacer piece that is arranged along the axis of rotation of the suction roll.

The partition wall of the present invention may include a support frame constructed on the interior surface of the suction roll. Moreover, the partition wall may include a continuous panel. The continuous panel may include sheet metal and/or a synthetic material. Alternatively, the partition wall may include a plurality of individual panels. This plurality of individual panels may include sheet metal and/or a synthetic material.

Another aspect of the present invention provides a drying section for processing a web which includes: a suction roll having a perforated cylinder sleeve, where the suction roll has an interior surface that defines a roll interior, and an axis of rotation, such that the roll interior can be put under a vacuum; a manhole in the suction roll that provides access to the roll interior; and a partition wall that divides the roll interior into sections formed essentially perpendicular to the axis of rotation, where the partition wall facilitates a differential vacuum between the sections, and where the partition wall is inserted through the manhole into the roll interior. The drying section also may include a transport band for guiding the web on the suction roll. Moreover, the partition wall may include a flexible material. Further, the partition wall may include a radial brace and a spacer arranged along the axis of rotation of the suction roll. This partition wall also may include a support frame positioned on the interior surface of the suction roll. Further, according to the present invention, the radial brace, the spacer and the support frame may be inserted through the manhole into the roll interior.

The partition wall may include a continuous panel segment. This continuous panel segment, may include sheet metal and/or a synthetic material. Alternatively, the partition wall may include multiple panel segments. These multiple panel segments may include sheet metal and/or a synthetic material.

The aforementioned and following characteristic features of the present invention can be used not only in the described combinations, but also in other combinations or alone, without departing from the scope of the invention. Further embodiments and advantages can be seen from the detailed description and the accompanying Figures.

BRIEF DESCRIPTION OF THE DRAWINGS

The present invention is further described in the detailed description which follows, in reference to the noted drawings by way of non-limiting examples of preferred embodiments of the present invention, in which the reference numerals represent similar parts throughout the several views of the drawings, and wherein.

DETAILED DESCRIPTION OF THE INVENTION

Figure 1:
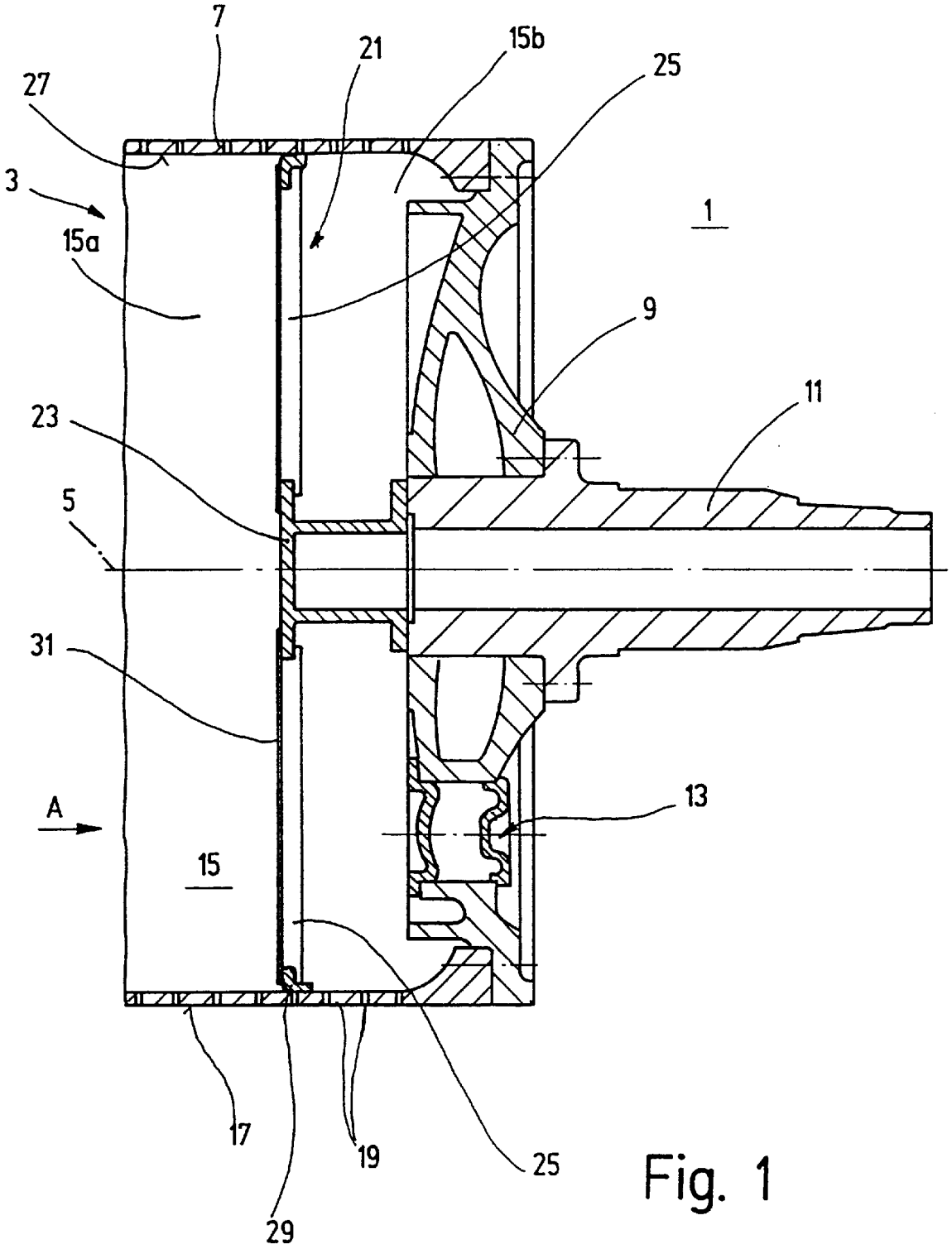
FIG. 1 shows a drying section of a machine for processing a continuous material web, specifically showing a longitudinal view through the end section of a suction roll.

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

The machine section described below processes a continuous material web. For instance, this machine could be used to manufacture a paper web.

FIG. 1 shows a section of a machine 1, which can have one or more suction rolls. The material web is guided around this suction roll preferably with the aid of a transport band, which is also referred to as a felt or drying sieve. Suction roll 3 is illustrated in a partial section here, showing the end section of the suction roll in a longitudinal section that cuts through the axis of rotation 5. Suction roll 3 includes a perforated cylinder sleeve 7 which is connected over bearing cap 9 with bearing neck 11. Manhole 13, which acts as a service opening, is installed in the bearing cap and is covered with a suitable lid. FIG. 1 shows that the size of the manhole, measured in radial direction, or in the direction of the diameter of the suction roll 3, is significantly smaller that the diameter of the suction roll. In this regard, the suction roll can, for example, have a diameter of about 1.8 m.

Interior 15 of suction roll 3 is put under a vacuum with the aid of a suction box (not shown) that is positioned in the area of the circumference 17, such that air is sucked from interior 15 and holes 19 in cylinder sleeve 7.

As illustrated here, partition wall 21 subdivides the roll interior into two sections 15*a* and 15*b*. The partition wall extends through the entire interior 15, so that it becomes possible to create a differential vacuum in the sections of the roll. The end section of suction roll 3 of section 15*b* is preferably put under intense vacuum during the threading process of the web in order to feed the lead-in strip through the machine during web manufacture.

The partition wall 21 is connected over spacer piece 23 to bearing neck 11, which is arranged concentric with axis of rotation 5. Braces 25, which extend in a radial direction, project from spacer piece 23 and are mounted on the support frame that is attached to interior surface 27 of the suction roll. One or more panels 31 are mounted on this frame structure, can be constructed from the spacer piece, the braces and the support frame.

Braces 25 and support frame 29, which can be assembled of individual elements, are constructed such that they can be inserted into the interior 15 of the suction roll 3 through the manhole 13, and then be mounted their appropriate locations. The same is true for the spacer piece 23, which can also be assembled of several elements.

Panel 31 is manufactured of a flexible material, for example sheet metal or a synthetic material, such that the panel that can be deformed and inserted through manhole 13 into the roll interior 15. The panel 31 can be constructed as a circular panel or as circular ring with a central opening positioned on spacer piece 23. If panel 31 consists of individual segments (also referred to as sectors or sections) it is possible to make them sufficiently small so that they can be inserted though manhole 13 into roll interior 15. However, by using flexible material to make the panel segment(s), it also is possible to bend, fold or roll them together, in order to guide the panel segment(s) through manhole 13 into roll interior 15.

Figure 2:
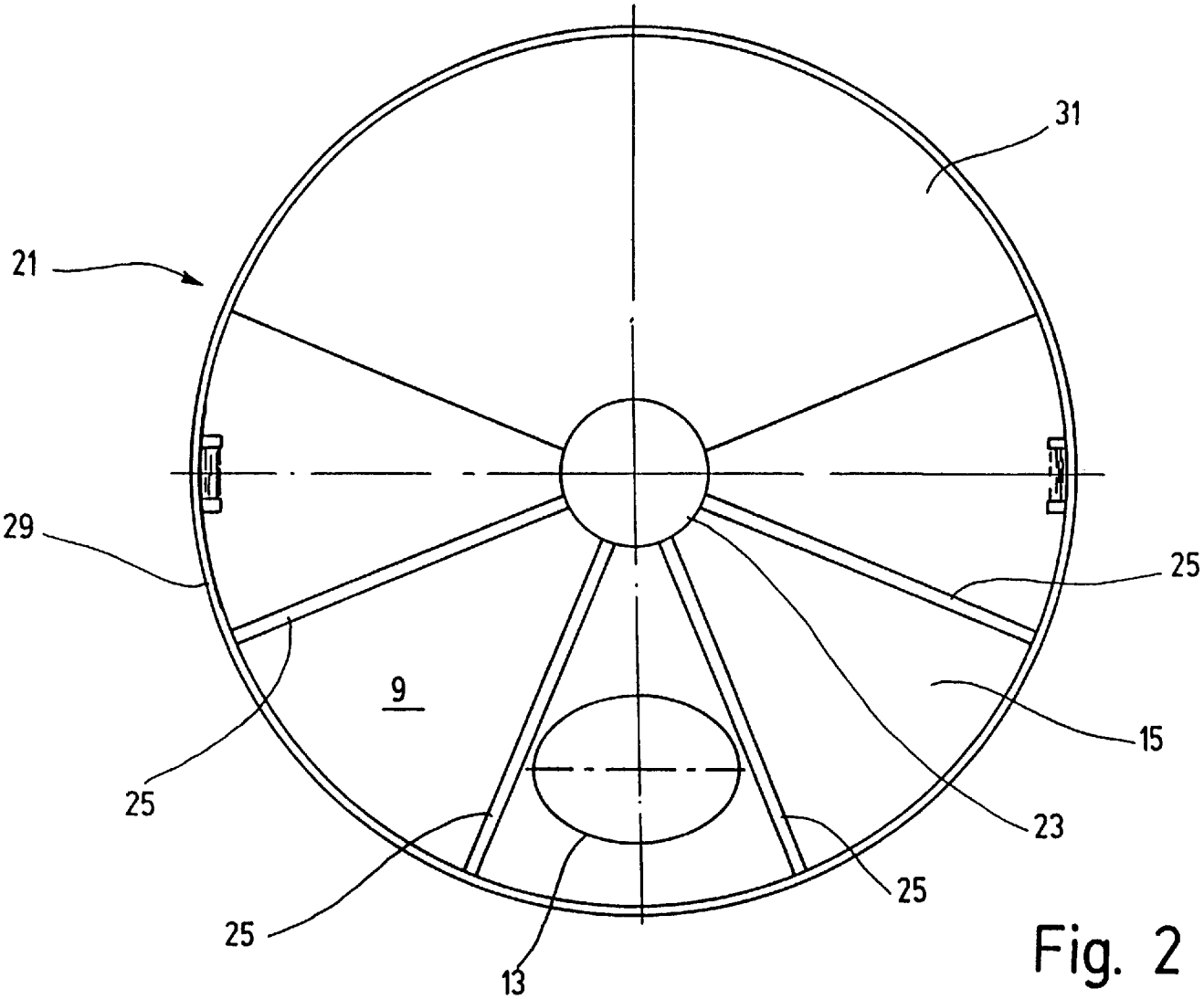
FIG. 2 shows a cross section view of the suction roll of FIG. 1.

FIG. 2 shows a top view of the partition wall 21. This schematic illustration shows support frame 29 being mounted on the interior surface of a suction roll cylinder sleeve (not shown). However, braces 25, which project from spacer piece 23 and to which the support frame is mounted, are clearly visible. In the embodiment illustrated here for exemplary purposes, a total of eight braces are proposed. However, not all the panels are mounted, so that the interior side of bearing cap 9 and manhole 13 is visible through the space between two neighboring braces. In this Figure, the manhole is constructed in an oval shape, where its elongation, measured in the horizontal direction, is larger than that measured in the radial direction.

In FIG. 2 one panel section extends over and covers three braces 25. It also is conceivable that a panel element 31 is used so that it extends over a circumferential angle of 120 degrees. However, it also is within the scope of the invention to design a panel for each of the three segments and to mount the individual elements onto braces 25, and, if necessary, onto the support frame and/or the spacer piece 23.

Alternatively, one whole panel, consisting of an elastic material which can therefore be rolled or folded and inserted through manhole 13 into interior 15, can be mounted on the frame created by braces 25, spacer piece 23 and support frame 29. It also is within the scope of the invention to manufacture panels that are, for example, half as wide as the area bounded by two neighboring braces 25. Such narrow panels can then also be inserted through manhole 13 and into roll interior 15, even if the panel material or segments do not permit deformation. Segments of the panels that could be mounted on a section between two braces 25 have to be elastically flexible with the designed manhole 13 dimensions so that they can be fed through manhole 13.

From the above, it is evident that partition wall 21 can be easily installed into the roll interior 15. It thus becomes possible to retrofit conventional suction rolls in order to subdivide their roll interiors, and to exert different pressures/vacuums therein. Of course, it also is possible to create more than two sections if needed.

In view of the above, it is clear that the assembly of partition wall 21 into various shapes does not affect the underlying objective of this invention. Further, it is possible to construct partition wall 21 with numerous narrow panel elements, although this would increase the assembly time. A single elastic panel that can be folded, or rolled, so that it can be guided through manhole 13 is therefore preferred. It also is very feasible to use individual segments of a panel unit that can stretch over sections bounded by the braces, and to construct these segments of elastic material. The size of panel elements only has to be limited to the maximum elongation of manhole 13, if a non-elastic material is to be used.

The partition wall also can be manufactured of several materials, for instance, a combination of sheet metal and synthetic material. It is important for these panels to be flexible if their size exceeds the largest dimension of manhole 13.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular materials and embodiments, the invention is not intended to be limited to the particulars disclosed herein; rather, the invention extends to a functionally equivalent structures, methods and uses, such as are within the scope of the appended claims.

What is claimed is:

1. A machine for manufacturing a continuous material web, in particular a paper- or cardboard web, comprising:

a suction roll including a manhole, at least one perforated cylinder sleeve, and an interior surface that defines a roll interior, wherein the roll interior can be put under a vacuum, and wherein the material web is guided on the suction roll;

a partition wall arranged to divide the roll interior into at least two sections, the partition wall arranged essentially perpendicular to a rotation axis of the suction roll; and the partition wall, being insertable through the manhole for installation in the roll interior, comprising one of:

the partition wall constructed of a flexible material sufficiently flexible for insertion through the manhole for installation in the roll interior; and the partition wall comprising a plurality of sections, said plurality of sections comprising at least one of:

flexible sections which are insertable through the manhole; and sections sized for insertion through the manhole.

2. The machine according to claim 1, wherein the material web is guided on the suction roll with the aid of a transport band.

3. The machine according to claim 1, the partition wall comprising a brace.

4. The machine according to claim 1, the partition wall comprising a spacer piece that is arranged along the axis of rotation of the suction roll.

5. The machine according to claim 1, the partition wall comprising a support frame constructed on the interior surface of the suction roll.

6. The machine according to claim 1, the partition wall comprising a continuous panel.

7. The machine according to claim 6, the continuous panel comprising at least one of sheet metal and a synthetic material.

8. The machine according to claim 1, the partition wall comprising a plurality of individual panels.

9. The machine according to claim 8, the plurality of individual panels comprising at least one of sheet metal and a synthetic material.

10. A drying section for processing a web, comprising:

at least one suction roll comprising a perforated cylinder sleeve, the at least one suction roll having an interior surface that defines a roll interior, a manhole to provide access to the roll interior, and an axis of rotation, wherein the roll interior can be put under a vacuum;

a partition wall that divides the roll interior into sections, the partition wall positioned essentially perpendicular to the axis of rotation, wherein the partition wall facilitates a differential vacuum between the sections, the partition wall composed of at least one of multiple panel segments and a flexible material insertable through the manhole into the roll interior.

11. A drying section according to claim 10, comprising a transport band for guiding the web on the suction roll.

12. A drying section according to claim 10, the partition wall being composed of the flexible material.

13. a drying section to claim 10, the partition wall comprising:

a radial brace; and a spacer arranged along the axis of rotation of the suction roll.

14. A drying section according to claim 13, the partition wall further comprising a support frame positioned on the interior surface of the suction roll.

15. A drying section according to claim 13, wherein the radial brace, the spacer and the support frame are inserted through the manhole into the roll interior.

16. A drying section according to claim 10, the partition wall comprising a continuous panel segment.

17. A drying section according to claim 16, wherein the continuous panel segment comprises at least one of sheet metal and a synthetic material.

18. A drying section according to claim 10, the partition wall being composed of the multiple panel segments.

19. A drying section according to claim 17, wherein the multiple panel segments comprise at least one of sheet metal and a synthetic material.

* * * * *